United States Patent [19]

Nail

[11] Patent Number: 4,770,407

[45] Date of Patent: Sep. 13, 1988

[54] APPARATUS AND METHOD FOR MERGING TWO SIGNATURE STREAMS

[75] Inventor: James W. Nail, Gastonia, N.C.

[73] Assignee: Craftsman Printing Company, Charlotte, N.C.

[21] Appl. No.: 8,489

[22] Filed: Jan. 29, 1987

[51] Int. Cl.[4] ..... B65H 5/02

[52] U.S. Cl. ..... 271/275; 271/151; 271/198; 271/216

[58] Field of Search ..... 271/275, 198, 202, 203, 271/216, 151

[56] References Cited

U.S. PATENT DOCUMENTS

| | | | |
|---|---|---|---|
| 282,014 | 7/1883 | Stuart . | |
| 1,494,378 | 5/1924 | Schmidt | 271/198 |
| 1,931,454 | 10/1933 | Anderson . | |
| 2,268,304 | 12/1941 | Rapley | 271/198 |
| 2,847,109 | 8/1958 | Gauthier et al. . | |
| 3,292,505 | 12/1966 | Wiseman . | |
| 3,464,537 | 12/1969 | Thull . | |
| 3,542,362 | 11/1970 | Brockmuller | 271/202 |
| 3,670,665 | 6/1972 | Levi . | |
| 3,671,034 | 6/1972 | de Ridder . | |
| 3,880,059 | 4/1975 | Brockmuller . | |
| 4,381,108 | 4/1983 | Newsome . | |

FOREIGN PATENT DOCUMENTS

| | | | |
|---|---|---|---|
| 240266 | 9/1964 | Austria | 271/198 |

*Primary Examiner*—Richard A. Schacher

*Attorney, Agent, or Firm*—Bell, Seltzer, Park & Gibson

[57] ABSTRACT

An apparatus and method for merging two separate streams of flat paper products or the like into a single stream of such products are disclosed, and wherein first and second longitudinally extending belt conveyors are provided within a frame. A drive is operatively connected to each of said first and second belt conveyors for advancing the same at corresponding speeds. Each belt conveyor has an entry end and a discharge end at opposing ends of said frame, with the two conveyors being vertically and laterally inclined with respect to each other such that the discharge end of one conveyor is vertically above and longitudinally aligned with the discharge end of the other belt conveyor. A deflection conveyor is positioned above the discharge end of the upper belt conveyor so as to downwardly deflect onto the lower belt conveyor those paper products conveyed on the upper belt conveyor.

15 Claims, 3 Drawing Sheets

10
11
12a
12b
14
20
21
22a
22b
22c
22e
22f
22g
23
23a
23b
24
24a
24b
25
30a
30b
31
32a
32b
33
34
35
37
40
41a
41b
42
43
44a
44b
45
46
52
53
54
6
7
S
S'

APPARATUS AND METHOD FOR MERGING TWO SIGNATURE STREAMS

BACKGROUND OF THE INVENTION

The present invention relates to the merging of two streams of flat paper products, and more particularly, to an apparatus and method for merging two separate streams of printed signatures into a single shingled stream.

Since the advent of modern printing, printing presses and the associated machinery adapted for finishing a printed product, e.g. slitting, folding, trimming, collating and binding, have become faster and more efficient in operation. For example, when printing folded flat signatures or other forms of flat paper products, a web offset press usually runs at speeds ranging from 600 to 2000 feet a minute. These modern web presses also typically incorporate a former-folder which has the capability of folding and then longitudinally slitting the printed paper products, to form two parallel streams of resulting paper products.

From the former-folder, the two streams of paper products are fed to a finishing line, which forms the paper products into finished products. However, modern finishing lines can only accommodate one stream of the paper products, and thus in cases where the former-folder produces two parallel streams of paper products, two duplicate finishing lines must be incorporated downstream of the former-folder in order to process both streams concurrently, which requires a large capital investment. Alternatively, one of the streams is processed on a single finishing line, and the other parallel stream is bundled and held for later finishing. As will be apparent, this latter procedure results in the loss of time and economy in production.

With the foregoing in mind, it is an object of the present invention to provide an apparatus and method for effectively merging the two separate high speed streams of flat paper products which exit a former-folder, into one stream of products which can then be delivered to a single finishing line.

SUMMARY OF THE INVENTION

The above and other objects and advantages of the present invention are achieved in the embodiment of the invention disclosed herein, and which includes an apparatus and method comprising first and second longitudinally extending belt conveyor means. Each of the belt conveyor means has an entry end and a discharge end, with the entry ends being disposed in a lateral side-by-side relationship. The first and second belt conveyor means are also vertically and laterally inclined with respect to each other so that the discharge end of the first belt conveyor means is disposed vertically above and longitudinally aligned with the discharge end of the second belt conveyor means. A deflection means is positioned above the first belt conveyor means and is inclined downwardly and extends longitudinally beyond the discharge end of the first belt conveyor means so as to downwardly deflect the paper products or the like which are conveyed from the discharge end of the first belt conveyor means. Drive means are operatively connected to each of the first and second belt conveyor means for advancing the same at predetermined relative speeds. the first and second belt conveyor means for advancing the same at predetermined relative speeds.

In the preferred embodiment, the deflection means comprises a third belt conveyor means with means rotably interconnecting the third belt conveyor means to the first and second belt conveyor means so that the first, second and third belt conveyor means advance at predetermined relative speeds to each other. Each of the first, second and third belt conveyor means include a plurality of laterally directed and parallel support rods and a plurality of separate belts entrained about the rods with the discharge end of the second belt conveyor means also extending longitudinally beyond the discharge end of the first belt conveyor means.

When those flat paper products which are conveyed along the first belt conveyor means have reached the discharge end of the first belt conveyor means, they contact the underside of the third belt conveyor means from which the paper products exiting off the first belt conveyor means are deflected downwardly onto those paper products advancing along the second belt conveyor means. The downward inclination of the third belt conveyor means together with its attendant forward motion also assures that during very fast operating speeds, those flat paper products discharged from the first belt conveyor means are still advanced forward during the time period when they are deflected downwardly onto the second belt conveyor means.

BRIEF DESCRIPTION OF THE DRAWINGS

Some of the objects and advantages of the present invention having been stated, others will be more fully understood by reference to the following drawings in which.

DESCRIPTION OF ILLUSTRATED EMBODIMENT

Figures 1, 2:
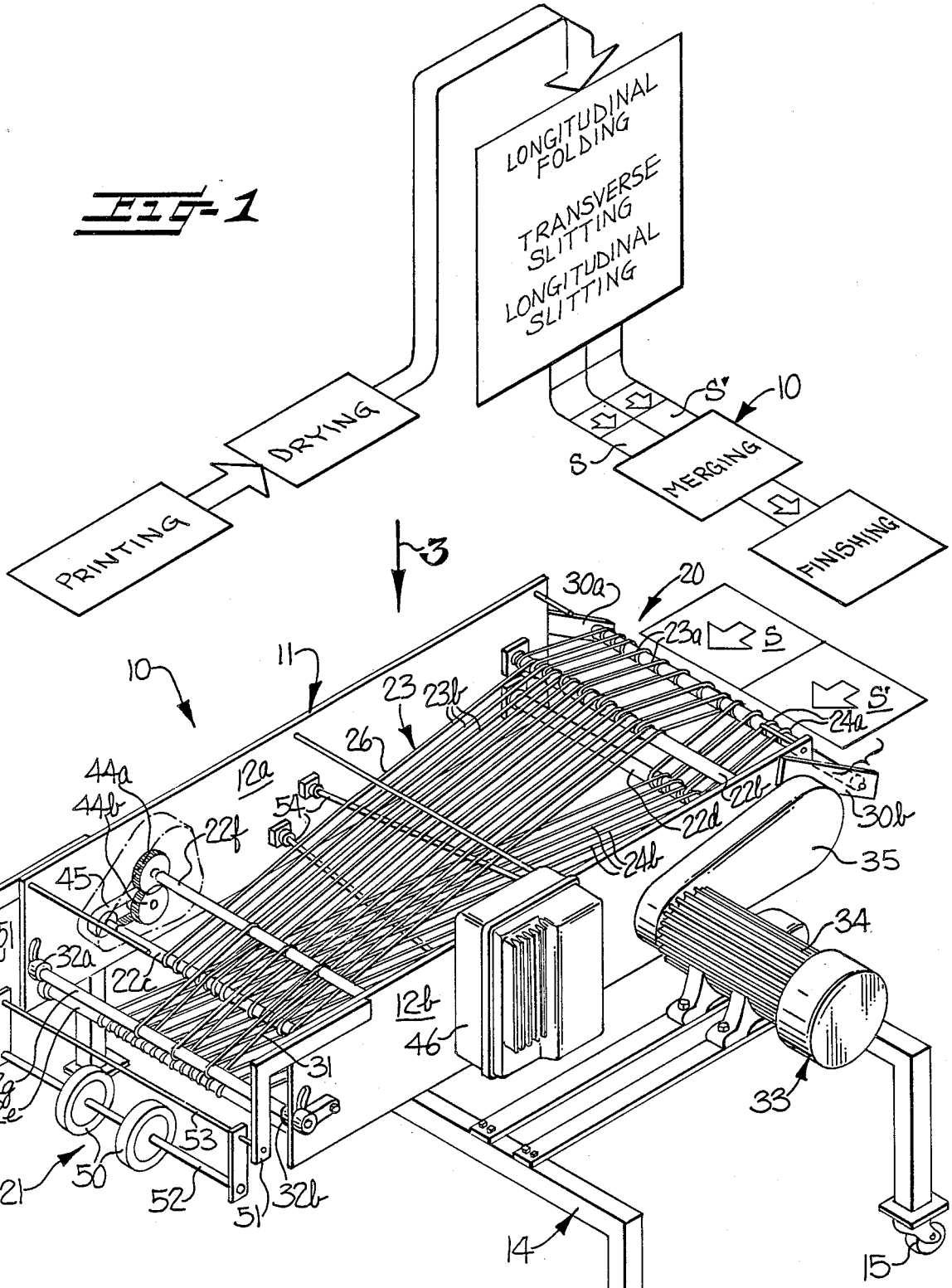
FIG. 1 is a flow chart representation of a typical web press operation which may produce either one or two signature streams.
FIG. 2 is an isometric view of a merging apparatus which incorporates the features of the present invention.

Referring now more particularly to the drawings, there is illustrated in FIG. 1 in flow chart representation a typical printing operation using a web press in conjunction with a former-folder.

In operation, a standard web press prints a continuous sheet drawn from a roll of printing paper. This sheet is subsequently dried and then drawn through a former-folder where it is longitudinally and transversely folded and then transversely cut so that a single stream of folded signatures or some other folded flat paper product is produced. The typical former-folder has the optional capability of longitudinally slitting the advancing sheet so as to produce two parallel streams of folded signatures or other folded flat paper products. Since a finishing line can accommodate only a single stream of signatures or other flat paper products, the double stream is merged by the merging apparatus indicated generally at 10, so that a single finishing line may be employed to finish the merged stream of paper products.

The apparatus 10 for merging two separate streams of flat paper products is illustrated in more detail in FIGS. 2–7, and it includes a frame 11 composed of opposing steel side walls 12*a* and 12*b* fixedly secured in a vertical position. The frame 11 rests upon a stand 14 having wheels 15 (FIG. 4) which facilitate the easy movement of apparatus 10. In a typical printing plant utilizing many presses of varying types and sizes, it is desirable to be able to move the merging apparatus 10 from one press to another depending on which press produces two separate streams of flat paper products and whether the two streams should be merged in order to facilitate finishing.

The frame 11 defines an entry end 20 and a discharge end 21 which is separated from the entry end 20 in a longitudinal direction. Rotatably mounted within the frame 11 are a plurality of laterally directed and parallel support rods 22*a*–22*g*. More particularly, there are provided an entry end rod 22*a* adjacent the entry end of the frame, a pair of vertically separated discharge end rods 22*c*, 22*e* adjacent the discharge end of the frame, a pair of vertically separated intermediate rods 22*b*, 22*d*, and a further pair of rods 22*f* and 22*g* adjacent the discharge end of the apparatus. All of these rods are parallel to each other, and extend in a direction which is perpendicular to the defined longitudinal direction.

A first belt conveyor means 23 is entrained about selected ones of the rods, and a second belt conveyor means 24 is entrained about other selected ones of the rods, as hereinafter further described. Also, both of the belt conveyor means 23 and 24 extend substantially between the entry end 20 and the discharge end 21.

Figure 8:
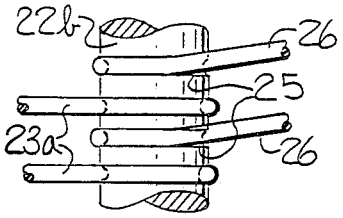
FIG. 8 is an enlarged fragmentary view of one of the support rods and associated belts of the apparatus.

As best seen in FIG. 8, a plurality of transversely spaced-apart annular grooves 25 of semi-circular outline are formed in each of the rods, as by machining, and each of the belt conveyor means 23 and 24 is composed of a plurality of elastic belts 26 of circular cross section, and which are entrained about the respective ones of the support rods 22*a*–22*g* so as to be received within the annular grooves 25 of the associated rods. As a specific example, the grooves 25 and elastic belts 26 may have like diameters of about 5 mm, and the belts may be formed of a suitable polymeric material. This configuration of semicircular grooves and round belts is also advantageous in that it permits the belts to extend laterally from the associated rod in the manner illustrated in FIG. 8.

Figure 3:
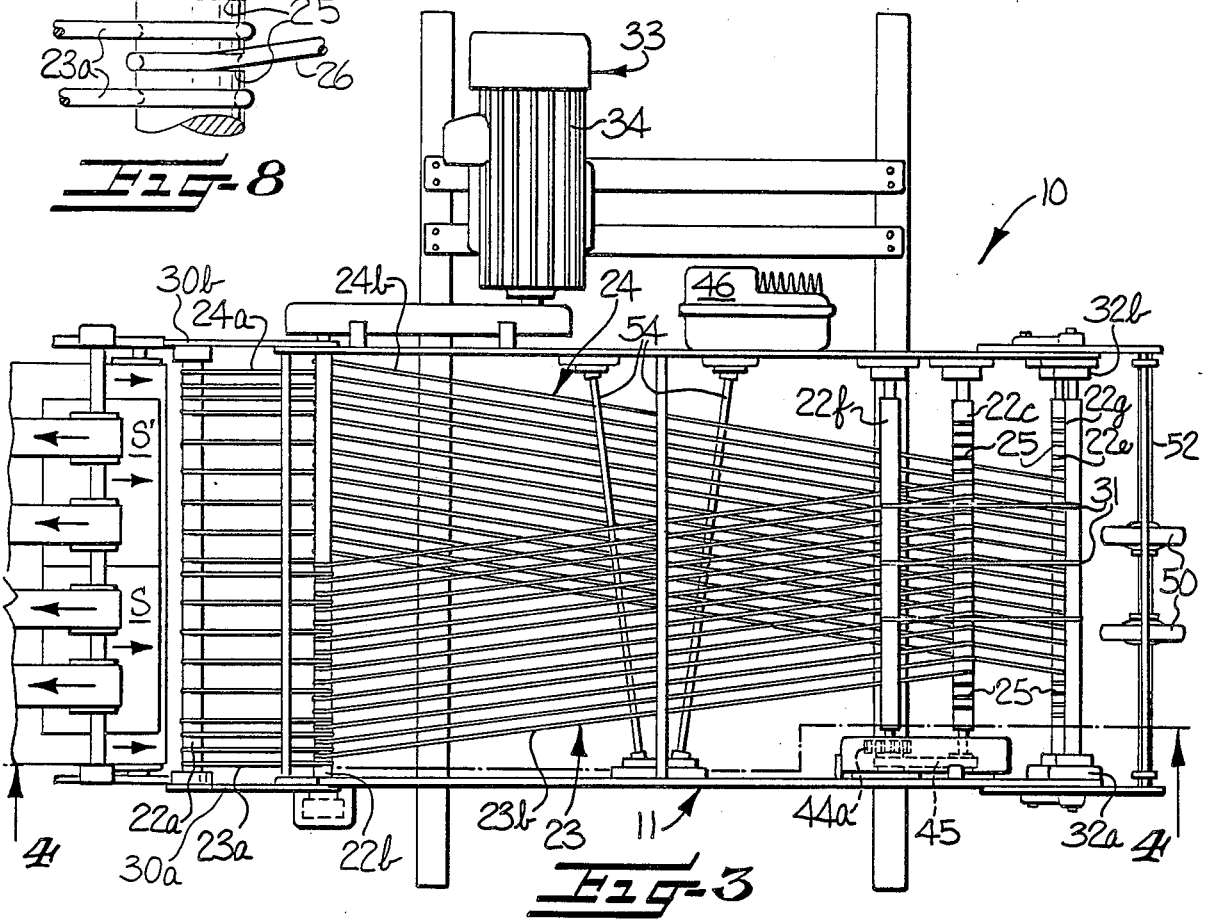
FIG. 3 is a top plan view of the apparatus.

Pivotally secured to the entry end 20 of the frame 11 are two support plates 30*a* and 30*b* which extend outwardly from the frame 11, and the entry end support rod 22*a* is rotatably mounted between the plates 30*a* and 30*b*. Both first and second belt conveyor means 23 and 24 include entry end segments which have one end mounted upon the entry end support rod 22*a*, and so as to define laterally spaced entry positions for both the first and second belt conveyor means 23 and 24 (FIG. 3). More particularly, the first belt conveyor means 23 includes an upwardly inclined segment 23*a* mounted to and extending in a longitudinal direction between the entry end support rod 22*a* and the upper intermediate support rod 22*b*, followed by an upper laterally directed segment 23*b* mounted to and extending in a laterally inclined direction between the upper intermediate support rod 22*b* and the upper discharge end support rod 22*c*.

The upper laterally directed segment 23*b* is angled so as to place the discharge end of this segment 23*b* at a point intermediate between both opposing side walls 12*a* and 12*b* and near the discharge end 21 of the frame 11 (FIG. 3). The second belt conveyor means 24 includes a downwardly inclined segment 24*a* mounted to and extending between the entry end support rod 22*a* and the lower intermediate support rod 22*d*. This downwardly inclined segment 24*a* is followed by a lower laterally directed segment 24*b* mounted to and extending between the lower intermediate support rod 22*d* and the lower discharge end support rod 22*e*. The lower discharge end support rod 22*e* is vertically separated from the upper discharge end support rod 22*c* of the first conveyor means 23 and is positioned within the frame 11 at a point closer to the discharge end 21 of frame 11 than the upper discharge end support rod 22*c*, and is positioned so that the lower laterally directed segment 24*b* of the second belt conveyor means 24 extends longitudinally beyond the upper laterally directed segment 23*b* of the first belt conveyor means 23. This lower laterally directed segment 24*b* is also angled so as to place the discharge end of this segment 24*b* at a point intermediate between both opposing side walls 12*a* and 12*b*. Thus, paper products or the like conveyed along the first belt conveyor means 23 will drop vertically onto the end portion of the laterally directed segment 24*b* of the second belt conveyor means 24.

Figure 4:
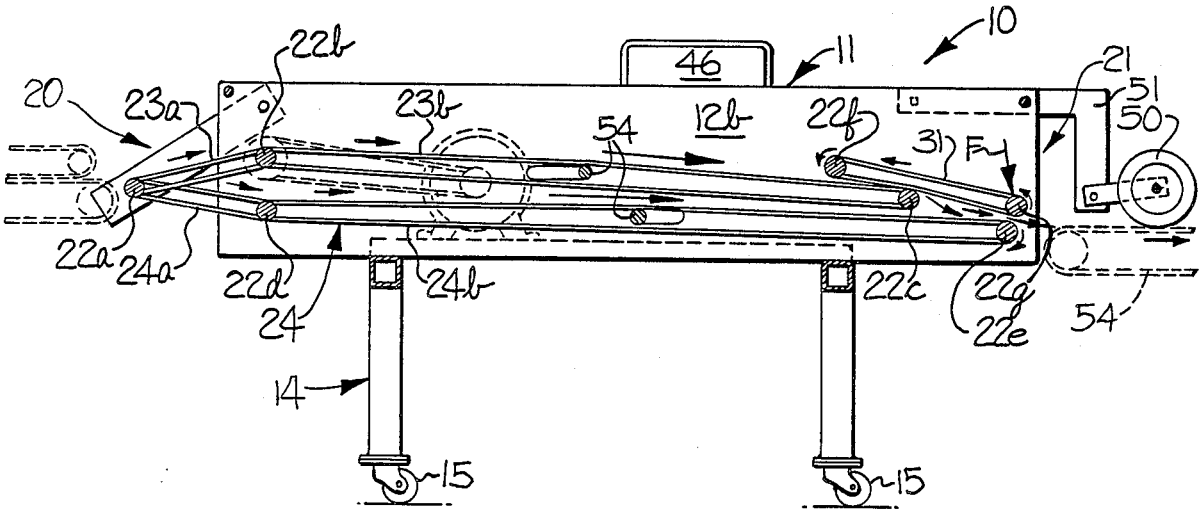
FIG. 4 is a sectional view taken along line 4—4 of FIG. 3.

A third longitudinally extending belt conveyor means 31 is positioned above the upper discharge end support rod 22*c* of the first belt conveyor means 23 and is inclined downwardly and extends longitudinally beyond the upper discharge end support rod 22*c* of the first belt conveyor means 23 so as to downwardly deflect the paper products or the like being conveyed from the first belt conveyor means 23 (FIG. 4). This third belt conveyor means 31 comprises the support rods 22*f* and 22*g*, and a plurality of round elastic belts which are entrained about annular grooves formed in the support rods 22*f* and 22*g* in the manner described above. Both of the support rods 22*f* and 22*g* extend laterally across the frame 11 and are parallel to each other and to the other support rods 22*a*–*e*. The support rod 22*g* is rotatably mounted within bearing housings 32*a* and 32*b*, which are vertically movable along a slot in the side walls 12*a* and 12*b*, and the rod 22*g* is biased downwardly by a suitable spring which is schematically indicated by the letter F in FIG. 4. Thus the rod 22*g* is able to vertically "float" against the force of the spring. The support rod 22*g* is positioned directly over the lower discharge end support rod 22*e* in the illustrated embodiment.

When the flat paper products which are conveyed along the first conveyor means 23 have reached the discharge end of the first conveyor means 23, they contact the lower run of the belts 26 of the thrid belt conveyor means 31. The resilient nature of the elastic belts helps deflect the paper products downwardly onto the second conveyor means, and since the support rod 22*g* is vertically movable, the distance between the two discharge end rods 22*e* and 22*g* may be adjusted to accommodate varying thicknesses of paper products which discharge from the first conveyor means 23.

Figures 5, 6, 7:
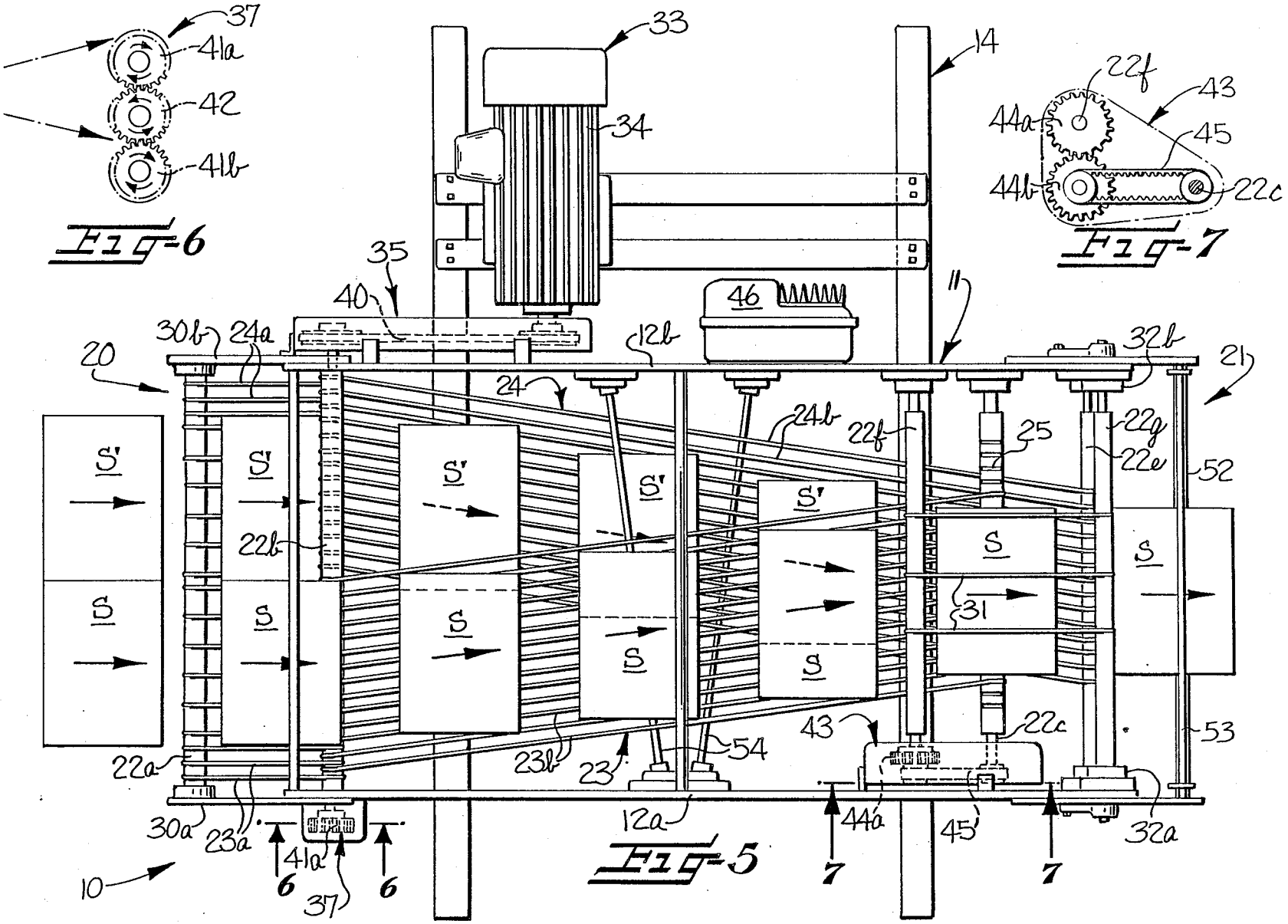
FIG. 5 is an enlarged top plan view similar to FIG. 3 and illustrating the merging of two separate streams of advancing signatures.
FIG. 6 is a sectional view taken along line 6—6 of FIG. 5 and showing the gear drive interconnecting two support rods of the first and second conveyor means.
FIG. 7 is a sectional view taken along line 7—7 of FIG. 5 and showing the drive transmission interconnecting the second and third conveyor means.

The apparatus 10 also includes a drive means 33, which is operatively connected to each of the first and second conveyor means 23 and 24 to advance the same at the same speeds. The drive means 33 comprises a DC electric motor 34 which is fixedly secured to the stand 14, with the control circuitry being housed in the control box 46. The motor 34 acts through a transmission 35 which comprises a timing belt 40 and associated sprockets to rotatably drive one end of the upper intermediate support rod **22*b* which extends through the side wall 12*b* of the frame 11 (FIG. 5). A second transmission 37 interconnects the first and second conveyor means 23 and 24, and comprises gear sprockets 41*a* and 41*b* secured onto the respective ends of the upper and lower intermediate support rod ends 22*b* and 22*d* which extend through the other side wall 12*a*. An intermediate gear 42 meshes with both gear sprockets 41*a* and 41*b* (FIGS. 5 and 6). It is evident, then, that when the first belt conveyor means 23 is advanced by the action of the motor driven transmission 35, the second belt conveyor means 24 also advances in the same direction, since the second belt conveyor means 24 is driven from the transmission 37 and the first conveyor means 23. If desired, the relative speeds of the two belt conveyor means 23 and 24 may be adjusted, by varying the size of the sprockets 41*a* and 41*b* relative to each other. However, in the preferred embodiment, the gear sprockets 41*a* and 41*b* and the intermediate gear 42 are of equal size, such that the conveyor means 23 and 24** advance at the same speed.

A transmission 43 operatively connects the upper discharge end support rod **22*c* of the first belt conveyor means 23 with the upper third conveyor means support rod 22*f* (FIGS. 5 and 7). In the preferred embodiment, the transmission 43 provides a one to one drive ratio between the first and third conveyor means 23 and 31 in order to permit them to operate at the same relative speeds. Since it is the lower run of the belts of the third belt conveyor means 31 which provides the downward deflecting force to the flat paper products which are discharged from the first conveyor means 23, it is readily apparent that the lower run of the third belt conveyor means 31 must advance in the same direction as the upper runs of the first and second belt conveyor means 23 and 24 (FIG. 4). This is provided by a pair of spur gears 44*a* and 44*b* coupled within the transmission 43 (FIG. 7). A timing belt 45 connects the upper discharge end support rod 22*c* with the spur gear 44*b*, and thus the gears 44*a*, 44*b* are rotated by the rotation of the rod 22*c*. The timing belt 45 and spur gears 44*a* and 44*b* are all geared at a ratio to assure that the third conveyor means 31 advances at the same speed as the first and second conveyor means 23 and 24**.

As best seen in FIG. 1, the discharge end of the apparatus includes a pair of side members 51 which mount a support rod 53 therebetween, and a bracket assembly 52 is pivotally mounted to the support rod 53. The bracket assembly 52 in turn rotatably mounts a pair of slowdown wheels 50. The wheels 50 and bracket assembly 52 normally hang downwardly as seen in FIGS. 1 and 3, but they may be lifted to rest upon a discharge conveyor as indicated at 54 in FIG. 4.

During the actual printing operation, the merging apparatus 10 may be conveniently moved to the exit end of any suitable press producing two separate streams of flat paper products. The wheels 15 secured to the stand 14 facilitate the easy movement among the various presses which is a necessity when various printing runs from different presses produce either single or double streams of printed products. As best seen in FIGS. 3 and 4, the two support plates **30*a* and 30*b* may be pivoted so as to allow the entry end support rod 22*a* to be placed in alignment with the discharge end of the press. Finished paper products exiting from the press are then easily fed onto the merging apparatus 10**.

Referring now to FIG. 5, two streams of flat paper products or sheets S and S′ are shown as they advance after exiting from a typical former-folder in a side-by-side arrangement, and after having been longitudinally and transversely folded and transversely and longitudinally cut. The merging apparatus 10 is aligned with the exit end of the former-folder so that one stream of sheets S is conveyed directly onto the first conveyor means 23 and the second stream S′ is conveyed directly onto the second conveyor means 24. To assure that the sheets exiting from the press do not "pile up" at the apparatus entry end 20, the motor 34 is preferably operatively connected to a tachometer (not shown) which measures the speed of the printing press. Thus, each of the first, second and third conveyor means 23, 24 and 31 will operate at a speed correlated to the speed of the printing press. It is understood, that in this particular preferred embodiment, the transmission means 37 and 43 are geared to permit the first, second and third conveyor means 23, 24 and 31 to move at the same speed relative to each other. Thus, the pair of sheets S, S′ which are initially fed onto the first and second conveyor means 23 and 24 advance at the same speed relative to each other and relative to the speed of the press. As both sheets S and S′ advance, they become vertically aligned with respect to each other since the first conveyor means 23 extends upwardly and then laterally to the longitudinal center of the apparatus, and the second conveyor means 24 extends downwardly and then laterally in the opposite direction to the longitudinal center. When the sheet S reaches the end of the first conveyor means 23, it drops onto the sheet S′ advancing along the second conveyor means 24, and the sheet S is slightly behind the sheet S′ in the longitudinal direction. To assure that each top sheet S drops smoothly onto the bottom sheet S′ advancing along the second conveyor means 24, the lower run of the resilient belts 26 of the third conveyor means 31 applies a downward pressure onto those sheets S which drop off the first conveyor means 23 (FIG. 4). Since the third conveyor means 31 is inclined downwardly to a point directly above the lower discharge end support rod **22*e*, those sheets S discharging from the first conveyor means 23 are deflected downwardly into a position overlying a sheet S′ advancing along the second conveyor means 24. Also, the spur gears 44 in the transmission means 43 cause the lower run of the third conveyor means 31 to advance in the same direction as the upper run of the first and second conveyor means 23 and 24. Thus, not only do the belts 26 aid in deflecting a sheet S downward, but the forward motion of the lower run of the belts moving at the same speed as the other conveyor means 23 and 24 helps maintain the advancement and guidance of the sheets as they are deflected downwardly. Thus, even at very high merging speeds, e.g. 16 sheets a second, the third belt conveyor means 31 acts to advance and guide each sheet S dropping off the first belt conveyor means into a shingled and overlapping relationship with those sheets S′ advancing along the second conveyor means 24. Since the lower third conveyor means support rod 22*g* is positioned directly over the lower discharge end support rod 22*e*** while also being able to float vertically, the distance between the two discharge end support rods 22*e* and 22*g* as well as the pressure exerted on the upper discharge end support rod 22*c* by the lower run of the third conveyor means 31 may be adjusted to accommodate varying thicknesses of paper products. As the merged sheets S and S' exit the discharge end 21 of the apparatus 10, they are received on the discharge conveyor 54 and contact slow down wheels 50. The conveyor 54 and slow down wheels 50 slow the now merged stream of advancing paper products, and thus the merged stream "builds up" at the slow down wheels 50 while the conveyor 54 then carries the "built up" and merged stream to the appropriate finishing line.

An excess number of the annular grooves 25 are preferably formed in each support rod 22*c* and 22*e* (FIG. 3), and are located along the entire length of these rods. Thus, the belt locations on these rods can be adjusted laterally. This lateral adjustment of the belts 26 may be employed to offset the downstream end of the conveyor means 23 and 24 from each other a selected amount, and to permit the paper products to be laterally displaced a selected distance from each other after merging. Guide bars 54 are positioned within the frame 11 and extend transversely from one side wall 12*a* to the other side wall 12*b* and extend between the top and underside of the first and second conveyor belt means 23 and 24. These guide bars 54 prevent excessive bounce and play of the belts 26 when the belts 26 are advanced at high rates of speed.

It will be understood that the specification and examples are illustrative but not limiting of the present invention, and that other embodiments within the spirit and scope of the invention will suggest themselves to those skilled in the art.

That which is claimed is:

1. An apparatus for merging two signature streams of flat paper products or the like into a single stream of such product, and comprising first and second longitudinally extending belt conveyor means, with each of said belt conveyor means having an entry end and a discharge end, and wherein the entry ends are disposed in a laterally side-by-side relationship, and said first and second belt conveyor means are vertically and laterally inclined with respect to each other and such that said discharge end of said first belt conveyor means is disposed vertically above and longitudinally aligned with the discharge end of said second belt conveyor means, and wherein said discharge end of said second belt conveyor means extends longitudinally beyond said discharge end of said first belt conveyor means, third belt conveyor means positioned above said discharge end of said first belt conveyor means, with said third belt conveyor means being inclined downwardly and extending longitudinally beyond said discharge end of said first belt conveyor means so as to downwardly deflect paper products or the like being conveyed from said discharge end of said first belt conveyor means onto said second belt conveyor means, and drive means operatively connected to each of said first, second, and third belt conveyor means for advancing the same at predetermined relative speeds.

2. The apparatus as defined in claim 1 wherein said third belt conveyor means includes an upstream end and a downstream end, and means resiliently mounting said downstream end so as to permit limited upward movement of the same against a downward biasing force, and so that the vertical spacing between said discharge end of said first belt conveyor means and said third belt conveyor means is adjustable to accommodate paper products or the like of varying thickness.

3. The apparatus as defined in claim 2 wherein each of said first and second belt conveyor means includes a plurality of laterally directed and parallel support rods, and a plurality of separate belts entrained about said rods.

4. The apparatus as defined in claim 3 wherein said laterally directed support rods of each of said first and second belt conveyor means each include a plurality of laterally spaced apart annular grooves, and wherein said belts are of generally circular cross section so as to be received in respective aligned pairs of grooves of the associated rods.

5. The apparatus as defined in claim 4 wherein said third belt conveyor means comprises a pair of laterally directed and parallel support rods, and at least one belt entrained about said rods.

6. The apparatus as defined in claim 5 wherein said drive means comprises a common electrical motor, and transmission means for operatively connecting said motor to selective ones of said support rods of each of said first, second, and third belt conveyor means.

7. The apparatus as defined in claim 2 wherein said first belt conveyor means includes an initial upwardly inclined segment, and a second laterally inclined segment.

8. The apparatus as defined in claim 7 wherein said second belt conveyor means includes an initial downwardly inclined segment, and a second laterally inclined segment, with the direction of inclination of said second inclined segment of said second belt conveyor means being opposite that of said second laterally inclined segment of said first belt conveyor means.

9. An apparatus for merging two separate streams of flat paper products or the like into a single stream of such products, and comprising a frame defining an entry end and a discharge end which is separated from said entry end in a longitudinal direction, a plurality of laterally directed and parallel support rods rotatably mounted to said frame, with each of said rods having a plurality of annular grooves therein, and a plurality of belts entrained about respective ones of said rods and so as to be received within the grooves of the associated rods, and such that said rods and belts define a first longitudinally extending belt conveyor means extending substantially between said entry end and said discharge end, and a second longitudinally extending belt conveyor means extending substantially between said entry end and said discharge end, and with said entry ends being disposed in a laterally side by side relationship, and with said first and second belt conveyor means including vertically and laterally inclined segments such that said discharge end of said first belt conveyor means is vertically above and longitudinally aligned with the discharge end of said second belt conveying means, and drive means operatively connected to selected ones of said rods for advancing said first and second belt conveyor means at corresponding speeds.

10. The apparatus as defined in claim 9 wherein at least one of said first and second belt conveyor means includes a laterally directed segment, and which includes parallel ones of said support rods at respective ends of the laterally directed segment, and with the associated belts extending between such parallel rods in a laterally inclined direction.

11. The apparatus as defined in claim 10 wherein said support rods include an entry end rod adjacent said entry end of said frame, a pair of vertically separated discharge end rods adjacent said discharge end of said frame, and a pair of vertically separated intermediate rods, and wherein said first belt conveyor means includes a first segment extending between said entry end rod and the upper one of said intermediate rods, and a second segment extending between said upper one of said intermediate rods and the upper one of said discharge end rods, and wherein said second belt conveyor means includes a first segment extending between said entry end rod and the lower one of said intermediate rods, and a second segment extending between said lower one of said intermediate rods and the lower one of said discharge end rods.

12. The apparatus as defined in claim 11 wherein said second segment of said second belt conveyor means extends longitudinally beyond said discharge end rod of said second segment of said first belt conveyor means, and such that the paper products or the like conveyed along said first belt conveyor means drop vertically onto said second segment of said second belt conveyor means.

13. The apparatus as defined in claim 12 further comprising a third longitudinally extending belt conveyor means positioned above said discharge end rod of said first belt conveyor means, with said third belt conveyor means being inclined downwardly and extending longitudinally beyond said discharge end rod of said first belt conveyor means so as to downwardly deflect the paper products or the like being conveyed along said first belt conveyor means.

14. A method of merging two separate streams of flat paper products into a single stream of such products and comprising the steps of advancing two streams of flat paper products along two adjacent and parallel paths of travel to an entry end of a merging apparatus, advancing said two streams from said entry end of said merging apparatus through the same and to a discharge end thereof, and including initially vertically upwardly inclining one of said streams and then laterally deflecting the same, and initially vertically downwardly inclining the second of said streams and then laterally deflecting the same, and such that said one stream is positioned above and parallel to said second stream at said discharge end, and guidingly contacting said one stream adjacent said discharge end so as to deflect said one stream downwardly onto the advancing underlying second stream, and so as to form a merged output stream.

15. A method as defined in claim 14 comprising the further step of withdrawing the merged output stream at a speed substantially slower than the speed of the advance of the two streams through said merging apparatus, and so that the output stream is shingled.

* * * * *